US006271449B1

(12) United States Patent
Enhoffer et al.

(10) Patent No.: US 6,271,449 B1
(45) Date of Patent: Aug. 7, 2001

(54) MUSICAL INSTRUMENT

(75) Inventors: Raymond Enhoffer, Clifton; Richard Simons, Garfield; Andrzej Krol, Lincoln Park; Kenneth Benjamin, Fairfield; Martin Cohen, Montvale, all of NJ (US)

(73) Assignee: Latin Percussion, Inc., Garfield, NJ (US)

( * ) Notice: Subject to any disclaimer, the term of this patent is extended or adjusted under 35 U.S.C. 154(b) by 0 days.

(21) Appl. No.: 09/496,779

(22) Filed: Feb. 3, 2000

(51) Int. Cl.[7] ..... G10D 13/08
(52) U.S. Cl. ..... 84/402; 84/403; 84/404
(58) Field of Search ..... 84/402, 403, 404

(56) References Cited

U.S. PATENT DOCUMENTS 471,046 * 3/1892 Wilskey ..... 84/402
4,779,507 * 10/1988 Shimoda et al. ..... 84/402
4,898,061 * 2/1990 Cohen et al. ..... 84/402
4,901,617 * 2/1990 Malone et al. ..... 84/402
5,207,769 * 5/1993 Malta ..... 84/404

* cited by examiner

*Primary Examiner*—Robert E. Nappi
*Assistant Examiner*—Kim Lockett
(74) *Attorney, Agent, or Firm*—Ohlandt, Greeley, Ruggiero & Perle, L.L.P.

(57) ABSTRACT

There is provided a musical instrument having a tubular body and a handle. The tubular body has an annular wall that defines a sound chamber. The handle is designed to shelter the hand of the player or serve as a mounting for use with a mounting cradle. The thickness of the tubular wall and the dimensions of the sound chamber may be modified to produce various sound qualities and pitches. Preferably, the musical instrument produces the characteristic sound of the traditional "clave."

20 Claims, 2 Drawing Sheets

MUSICAL INSTRUMENT

BACKGROUND OF THE INVENTION

1. Field of the Invention

The present invention relates to musical instruments. In particular, the present invention relates to percussion instruments.

2. Description of the Prior Art

Clave (pronounced clahvey) rhythm is the rhythmic pattern that forms the basis of Latin music. Clave rhythm is characteristically phrased as three beats followed by two beats, or two beats followed by three beats. Clave rhythm is typically played on a traditional instrument, which is conveniently called a "clave."

The clave is essentially a wooden rod that is held in one hand between the fingertips and the heel of the hand with the thumb used for lateral support. Holding the clave in this manner creates a sound chamber between the clave and the palm of the hand. Optionally, the clave may have a hollowed-out depression on the side facing the palm, which increases the size of the sound chamber. The clave is struck by a second wooden rod, known as the "striker." Hitting the striker and the clave together produces a distinctive, sharp, cracking sound. The distinct sound produced by the traditional clave is highly desirable to clave players and Latin music aficionados.

However, the traditional clave is a difficult instrument to play. If it is held incorrectly, the traditional clave will not produce its characteristic sound. Furthermore, while playing the traditional clave, the player's fingers are positioned such that they are subject to being accidentally hit by the striker.

In addition, traditional claves made of wood suffer from the problems common to all wooden percussion instruments. First, wooden percussion instruments are costly to produce. Wooden percussion instruments also vary in sound and pitch due to variances in density, grain structure, and other physical properties of the wood. Moreover, continued striking of a wooden percussion instrument eventually results in splintering of the wood and failure of the instrument.

The disadvantages of wood have been partially overcome in prior art designs through the use of plastic and other synthetic materials. For example, U.S. Pat. No. 4,898,061 discloses a plastic block-type percussion instrument. In addition, co-pending U.S. application Ser. No. 09/237,645 discloses a plastic agogo bell, while co-pending U.S. application Ser. No. 09/096,879 discloses a plastic "napkin block."

Nonetheless, there is a need in the art for a clave that readily produces the characteristic clave sound and overcomes the disadvantages of wood. Surprisingly, it has been discovered that a plastic clave created as described herein can produce a sound characteristic of a traditional wooden clave.

SUMMARY OF THE INVENTION

It is an object of the present invention to provide a percussion instrument.

It is another object of the present invention to provide such a percussion instrument that is easy to play and will readily produce a sound characteristic of a traditional wooden clave, regardless of how the instrument is held.

It is a further object of the present invention to provide a percussion instrument that is produced of an inexpensive, durable material, while still producing a sound characteristic of a traditional wooden clave.

Accordingly, there is provided a plastic clave having a tubular body and a handle. The tubular body has an annular wall that defines a sound chamber. The handle is designed to shelter the hand of the player or serve as a mounting for one-handed playing. The thickness of the annular wall and the dimensions of the sound chamber may be modified to produce various sound qualities and pitches. It has been surprisingly discovered that a plastic clave produced according to the present invention can produce the characteristic sound of a traditional clave.

DETAILED DESCRIPTION OF THE INVENTION

Figure 1:
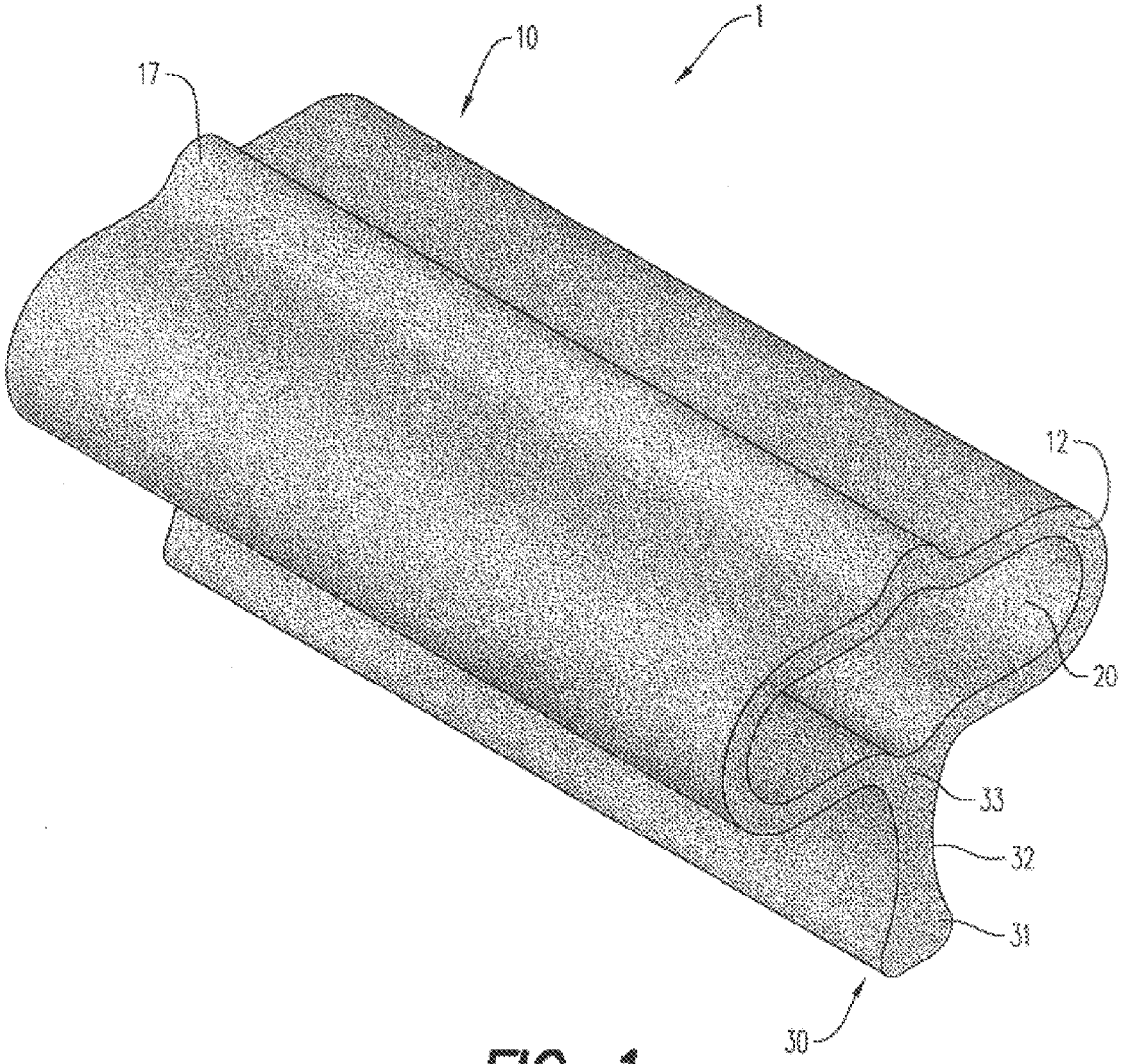
FIG. 1 is a top perspective view of a clave according to the present invention.

Referring to the drawings and, in particular, FIG. 1, there is provided a musical instrument according to the present invention, generally represented by reference numeral 1. Musical instrument 1 is identified herein as a "clave." Clave 1 has a tubular body 10 and an elegant, shaped handle 30.

Tubular body 10 has an annular wall 12 that is disposed about a central longitudinal axis. Annular wall 12 defines a tubular sounding chamber 20. Tubular sounding chamber 20 is preferably substantially open at both ends and is elongated along the central longitudinal axis. Tubular sounding chamber 20 is generally oval, elliptical, or rounded in shape along a cross-section transverse to the central longitudinal axis.

Figure 3:
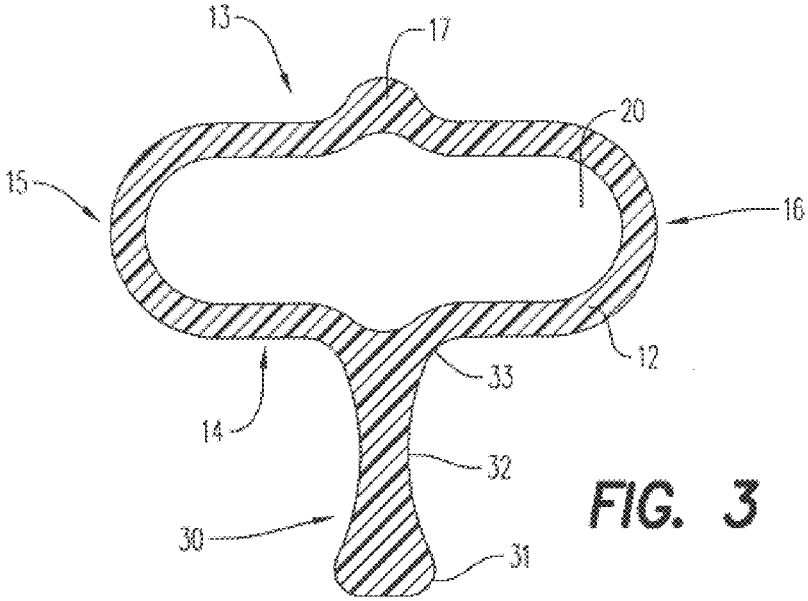
FIG. 3 is a cross section view of the clave of FIG. 2 taken along line A—A.

Referring now to FIG. 3, and given the generally oval, elliptical, or rounded shape of the cross section of sounding chamber 20, it is preferable that annular wall 12 have a broad, substantially flat top section 13 that is separated from a broad, substantially flat bottom section 14 by rounded, side sections 15 and 16.

The thickness of annular wall 12 may be modified to produce various sound qualities and pitches. Preferably, the thickness of annular wall 12 is about 5 mm to about 12 mm and, more preferably, about 8 mm. Also, annular wall 12 preferably has a uniform thickness, which results in a uniform sound or resonance regardless of the exact point at which clave 1 is struck.

The dimensions of sounding chamber 20 may also be modified to produce various sound qualities and pitches. The length of sounding chamber 20 is defined by the distance that annular wall 12 is elongated parallel to the central longitudinal axis. The height of sounding chamber 20 is defined by the distance between top section 13 and bottom section 14, while the width is defined by the distance between rounded side sections 15 and 16.

The length of sounding chamber 20 is preferably about 100 mm to about 225 mm and, more preferably, about 149.5 mm. The width of sounding chamber 20 is preferably about 50 millimeters (mm) to about 120 mm and, more preferably, about 64 mm. The height of sounding chamber 20 is preferably about 20 mm to about 50 mm and, more preferably, about 15.5 mm.

It is also preferable that sounding chamber 20 be divided into 3 sections, in which the central section has a greater height compared to the two side sections. More preferably, the central section is about 18.5 mm in height, while the side sections are about 15.5 mm in height.

Referring again to FIG. 1, a striking ridge 17 may be positioned on top section 13. Striking ridge 17 is preferably positioned along the longitudinal centerline of top surface 13, which results in maximum sound production or resonance when the striking ridge is beat with a striker body. Striking ridge preferably rises about 6.5 mm above top section 13.

Figure 2:
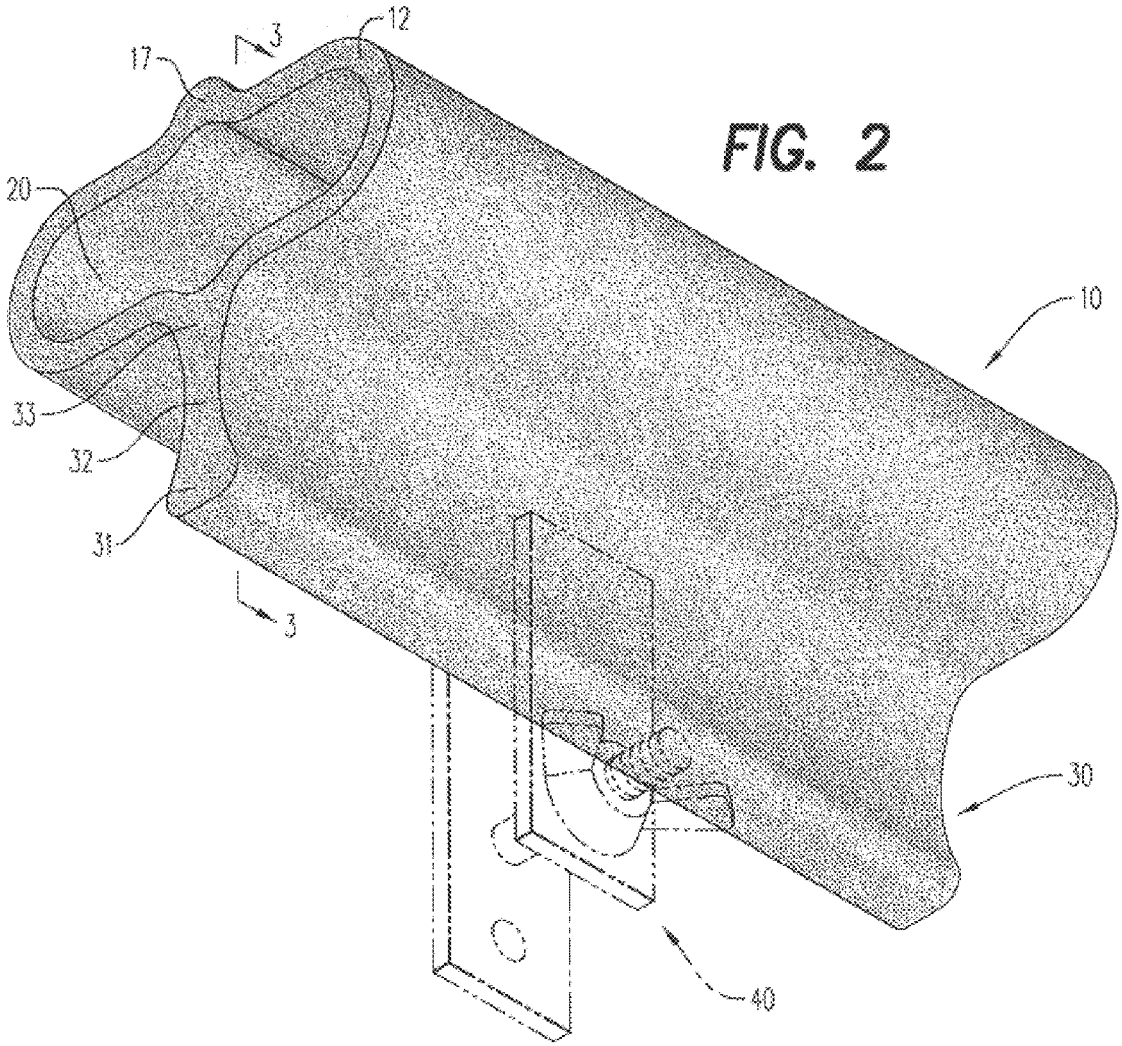
FIG. 2 is a bottom perspective view of the clave of FIG. 1, which is mounted within a bracket.

Referring to FIG. 2, handle 30 is attached to bottom section 14. Handle 30 is adapted to be gripped by the player for two handed playing or, alternatively, mounted within a bracket 40 during one-handed playing. Preferably, handle 30 is positioned along the longitudinal centerline of bottom section 14. Such a position primarily serves two purposes. First, positioning handle 30 along the longitudinal centerline of bottom surface 16 provides maximum shielding of the player's hand. Second, because handle 30 is optionally used as a striking ridge, centralized placement of handle 30 is preferred for the production of maximum sound or resonance when handle 30 is struck.

Primarily for the comfort of the clave player, it is preferable that handle 30 be molded or curved in an ergonomic fashion. Handle 30 preferably extends about 38 mm from bottom section 14 and has a length about equal to the length of tubular body 10. Furthermore, handle 30 preferably has a bulbous base 31, a tapered middle section 32, and a flared shoulder section 33 that is attached to bottom section 14. More preferably, bulbous base 31 is about 16 mm in width, middle section 32 is about 7 mm is width, and shoulder section 33 is about 16 mm in width. The foregoing dimensions for handle 30 result in a player holding clave 1 in a style that emulates the manner in which a traditional clave is held. However, handle 30 may be optionally shaped in various styles dictated by a desired application.

Clave 1 may be formed from a synthetic material. Such a material may include ABS, acrylic resins, other thermoplatic resins, and mixtures thereof, as well as fiberglass. A preferred material is high density polyethylene. In addition, clave 1 is preferably formed as a one-piece instrument by molding processes known to the art, such as injection molding, blow molding, or extrusion.

Given the foregoing, it is clear that a clave designed according to the present invention is formed of non-traditional materials into a non-traditional shape. It has been surprisingly discovered that a plastic clave shaped according to the present invention can produce a sound characteristic of a traditional wooden clave.

The present invention having been described with particular reference to the preferred forms thereof, it will be obvious that various changes and modifications may be made therein without departing from the spirit and scope of the present invention as defined in the appended claims.

Wherefore we claim:

1. A musical instrument comprising:

an annular wall disposed around a central axis, said annular wall having an upper section, a pair of side sections, and an opposing lower section spaced from said upper section by said pair of side sections, said annular wall defining a tubular sound chamber having substantially open ends; and a handle adapted to be connected to said lower section, said handle being adapted to be gripped by a hand, wherein said tubular body substantially shields said hand when the instrument is struck.

2. The musical instrument of claim 1, wherein said annular wall has a thickness about 5 mm to about 12 mm.

3. The musical instrument of claim 1, wherein said annular wall extends parallel to said central axis for a length about 100 mm to about 225 mm.

4. The musical instrument of claim 1, wherein said upper section is spaced from said lower section by about 20 mm to about 50 mm.

5. The musical instrument of claim 1 wherein said pair of side sections is spaced from each other by about 50 mm to about 120 mm.

6. The musical instrument of claim 1, wherein said annular wall has a substantially elliptical shape along a cross section transverse to said central axis.

7. The musical instrument of claim 6, wherein said substantially elliptical shape is about 50 mm to about 120 mm in width and about 20 mm to about 50 mm in height.

8. The musical instrument of claim 6, wherein said substantially elliptical shape comprises a central portion disposed between a pair of end portions.

9. The musical instrument of claim 8, wherein said central portion has a greater height compared to said end portions, and wherein said end portions have a greater width than said central portion.

10. The musical instrument of claim 1, wherein said upper section comprises a striking member adapted to be struck by said striking body.

11. The musical instrument of claim 10, wherein said upper section has a centerline parallel to said central axis, and wherein said striking member is positioned on said centerline.

12. The musical instrument of claim 1, wherein said lower face has a centerline parallel to said central axis, and wherein said handle is positioned on said centerline.

13. The musical instrument of claim 1, wherein said handle is disposed parallel to said central axis.

14. The musical instrument of claim 1, wherein said upper section has a striking member adapted to be struck by said striker, and wherein said striking member is positioned substantially opposite said handle.

15. The musical instrument of claim 1, wherein said handle is further adapted to be mounted on a stand.

16. The musical instrument of claim 1, wherein said handle is disposed so that the palm of said hand faces said tubular body and the fingers of said hand are substantially shielded by said lower section.

17. The musical instrument of claim 1, wherein said tubular body is integrally attached to said handle.

18. The musical instrument of claim 1, wherein said tubular body is made from a synthetic material.

19. The musical instrument of claim 18, wherein said synthetic material is selected from the group consisting of thermoplastic resins and fiberglass.

20. A plastic clave comprising:

an annular wall disposed around a central axis, said annular wall having an upper section, a pair of side sections, and an opposing lower section spaced from said upper section by said pair of side sections, said annular wall defining a tubular sound chamber having substantially open ends and a substantially elliptical shape along a cross section transverse to said central axis and; and a handle integrally connected to said lower section, said handle being adapted to be gripped by a hand, wherein said tubular body substantially shields said hand when said upper section is struck, and wherein striking said upper section with said striker produces a sound characteristic of a traditional wooden clave.

* * * * *